US007403081B2

(12) United States Patent
Parsche

(10) Patent No.: US 7,403,081 B2
(45) Date of Patent: Jul. 22, 2008

(54) BROADBAND HYBRID JUNCTION AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 155 days.

(21) Appl. No.: 11/553,540

(22) Filed: Oct. 27, 2006

(65) Prior Publication Data

US 2008/0100396 A1 May 1, 2008

(51) Int. Cl.
*H01P 5/12* (2006.01)
*H01P 5/22* (2006.01)
*H01F 27/28* (2006.01)

(52) U.S. Cl. ..... 333/119; 333/117; 336/170; 336/180

(58) Field of Classification Search ..... 333/119, 333/12, 26, 25; 365/140; 361/113; 336/233, 336/180, 170, 171, 183
See application file for complete search history.

(56) References Cited

U.S. PATENT DOCUMENTS

| | | | | |
|---|---|---|---|---|
| 1,679,240 A | | 7/1928 | Osanyi | 343/867 |
| 1,748,802 A | | 2/1930 | Seymour | 336/184 |
| 1,796,295 A | | 3/1931 | Loth | 342/433 |
| 1,905,216 A | | 4/1933 | Capps | 330/171 |
| 2,441,564 A | | 5/1948 | Combs | 242/448 |
| 3,168,715 A | * | 2/1965 | Woodworth | 333/119 |
| 4,274,051 A | * | 6/1981 | Condon | 324/117 R |
| 4,707,673 A | * | 11/1987 | Lee et al. | 333/112 |
| 5,200,718 A | * | 4/1993 | Kato | 333/25 |
| 5,699,048 A | | 12/1997 | Galloway | 340/572.5 |
| 6,215,386 B1 | * | 4/2001 | Gokita et al. | 336/182 |
| 2005/0030140 A1 | | 2/2005 | Dahlgreen et al. | 336/5 |

FOREIGN PATENT DOCUMENTS

| | | |
|---|---|---|
| EP | 0324136 | 7/1989 |
| GB | 193873 | 3/1924 |
| WO | WO0141319 | 6/2001 |

* cited by examiner

*Primary Examiner*—Dean O Takaoka
(74) *Attorney, Agent, or Firm*—Allen Dyer Doppelt Milbrath & Gilchrist

(57) ABSTRACT

The hybrid junction includes four electrically conductive planar windings, circular or rectangular, arranged so as to lie along an imaginary spherical or cylindrical surface. Each of the four electrically conductive windings is rotated from adjacent windings by about forty-five degrees. The four electrically conductive windings are electrically insulated from each other and each include a respective signal port. The hybrid junction automatically splits and/or sorts signals. Signals applied to any port will split equally between the opposite port pairs. One output signal will be in-phase with the input signal, and the other output signal will be shifted by 0 or 180 degrees from the input signal. The input signal is split equally, output coupling may be half power or loose, and there is isolation between the output ports. The hybrid junction operates over a broad bandwidth.

24 Claims, 9 Drawing Sheets

BROADBAND HYBRID JUNCTION AND ASSOCIATED METHODS

FIELD OF THE INVENTION

The present invention relates to the field of communications, to sorting and routing signals, and to the field of transformers and related methods.

BACKGROUND OF THE INVENTION

An important form of radio frequency (RF) power divider is the 3db hybrid coupler which is described in a number of references including Chapter 13 entitled "TEM-Mode, Coupled-Transmission-Line Directional Couplers, and Branch-Line Directional Couplers" of a book whose title is "Microwave Filters, Impedance-Matching Networks And Coupling Structures" by Matthaei, Young and Jones. The 3db hybrid coupler has two input ports and two output ports. With one input connected to a terminating impedance matched to the system characteristic impedance, a signal at the other input produces signals at the two outputs of the coupler each of which contains approximately one-half of the power engendered by the input signal (neglecting insertion loss). Depending on device form and connections, the outputs may differ in phase from each other by 0, 90, or 180 degrees. The 90 degree phase type sometimes is called a quadrature hybrid.

The Magic-T or Rat-Race hybrid ring circuit is another type, which throughout the past has been optimized with the purpose of obtaining a higher bandwidth (>40%). Various approaches to increase the bandwidth include using non-flat technology instead of the middle wave length line (asymmetric part) of the ring. The resulting ring is more symmetrical and the bandwidth is only limited by the interconnection of the quarter length wave sections. The hybrid ring can be described as a divider or 180 degree coupler, and is particularly useful in mixer and coupling signal circuits.

Generally then, the 0 degree hybrid coupler is a four-port network available from a number of manufacturers in a wide variety of package types, ranging over a frequency spectrum of 10 kHz to 18 GHz. The traditional function of a 0 degree hybrid coupler is to split an input signal into two equal amplitude, isolated 0 degree outputs or to combine to similarly phased, equal amplitude signals into a single output.

Operationally, a 0 degree hybrid coupler is a symmetrical network in that signals applied to any port will split equally between the opposite port pairs. An input signal applied to port 1 will split equally between ports 2 and 3. The output signals from ports 2 will be in-phase with the input signal at port 1. The input signal is split equally so that the two resulting output signals. An important natural characteristic of a 0 degree hybrid coupler is its reaction to mismatches. In the case of a common input mismatch, all reflections are directed to the isolated port 4, and as a result system match is not affected when port 4 is terminated in its characteristic impedance. The same condition holds true for output mismatches, reflections are directed to the isolated port 4. The standard hybrid coupler may also be used to combine two signals at ports 2 and 3 into an output signal at port 1.

U.S. Pat. No. 1,458,193, entitled "Multiple Balancing Arrangement For Multiplex Transmission", to Osbourne, describes a transformer type of the hybrid junction. In this type, transformer windings are tapped to create uncoupled ports, in like fashion to bridge circuits, such as the Wheatstone Bridge. Tapped winding hybrid transformers have found wide application, especially in telephone repeaters. One such 2 way amplifier, or "repeater", is described by Wright in U.S. Pat. No. 1,515,643, entitled "Transmission Circuits". This hybrid became key to long distance telephony, and they remain in use today, as for instance to reduce earpiece "sidetone" in telephone handsets to comfortable levels.

Unfortunately however, limitations can arise in tapped winding hybrid transformers. The multiplicity of windings is complex: a magnetic circuit or "core" is needed to ensure coupling between all, and in essence, 6 windings are required. Any number of difficulties can upset symmetry, causing unbalance. For instance, if the taps are not at the midpoint of the winding turns, or the magnetic core has a void, isolation between ports 1 and 4 is reduced. And since winding techniques vary, intricate care may be required in practice to achieve high isolation.

Hybrid junctions of the transformer type generally require a magnetic circuit or ferrite core, which limits frequency response. They may not operate above say 1 Ghz, or are narrowband above this. They also have limited power ratings and complex geometry, such as six windings and many cores.

What is needed then, is a more simple and uncomplicated hybrid junction, one that obtains 4 ports from 4 untapped windings, with or without a core, in the optimum geometry. There also remains, a need to identify a Euclidian or symmetric form of hybrid transformer with windings superimposed about a single point space.

SUMMARY OF THE INVENTION

In view of the foregoing background, it is therefore an object of the present invention to provide a broadband hybrid junction, such as a coupler or transformer, with a spherical or cylindrical geometry and spatial superposition of windings. The broadband junction is without tapped windings or bridging, and a magnetic core may be omitted.

This and other objects, features, and advantages in accordance with the present invention are provided by a hybrid junction including four circular electrically conductive windings arranged so as to lie along an imaginary spherical surface. Each of the four circular electrically conductive windings is spaced from adjacent windings by about forty-five degrees. The four circular electrically conductive windings are electrically insulated from each other and each includes a respective signal port.

Each of the circular electrically conductive windings may include a plurality of turns. Also, a core may be included within the four circular electrically conductive windings. The core may be one of a solid dielectric material, a gas dielectric material and a nonconductive magnetic material. The diameter of the imaginary spherical surface is preferably electrically small, being 1/20 of a wavelength or less in diameter. Each of the signal ports may preferably lie along an equator of the imaginary spherical surface, and each of the signal ports may be a coaxial signal port or a waveguide signal port. Furthermore, the signal ports are preferably connected to define a 180 degree coupler or a 0 degree coupler.

A method aspect is directed to a method of making a hybrid junction including forming four circular electrically conductive windings arranged so as to lie along an imaginary spherical surface, and spacing each of the four circular electrically conductive windings from adjacent windings by about forty-five degrees. The method also includes electrically insulating the four circular electrically conductive windings from each other, and providing a respective signal port for each of the four circular electrically conductive windings.

The method may also include providing a core within the four circular electrically conductive windings, wherein the core is a solid dielectric material, a gas dielectric material or a nonconductive magnetic material. Also, each of the signal ports may be preferably provided along an equator of the imaginary spherical surface and the signal ports may be balanced twisted pair, coaxial signal ports or with transitions, waveguide ports.

Objects, features, and advantages in accordance with the present invention are also provided by a hybrid junction including a cylindrical core with vias, and four rectangular (or square) electrically conductive windings wound therein. Each of the four rectangular electrically conductive windings is spaced from adjacent windings by about forty-five degrees. The four rectangular electrically conductive windings are electrically insulated from each other, and each includes a respective signal port.

The cylindrical core may be provided within the four rectangular electrically conductive windings, and the core may be a solid dielectric material, a gas dielectric material or a nonconductive magnetic material. Core length (l) and diameter (d) may be approximately equal, and the core of electrically small size, 1/20 wavelengths or less, such that (l=d)<1/20 wavelengths. Also, each of the signal ports may be a twisted pair transmission line, formed from the winding wires. The signal ports are preferably connected to define a 0 degree coupler or a 180 degree coupler, by reversing connection polarities.

Another method aspect is directed to a method of making a hybrid junction, including winding four rectangular electrically conductive windings in situation, after the cylindrical core has been constructed. Each of the four rectangular electrically conductive windings being rotated from adjacent windings by about forty-five degrees. Further, the method includes electrically insulating the four rectangular electrically conductive windings from each other, and providing a respective signal port for each of the four rectangular electrically conductive windings.

Another method may include providing a core within the four rectangular electrically conductive windings, after the windings are formed, the core being solid dielectric sections, a gas dielectric material or a nonconductive magnetic powder. The core may also be sectioned or comprised of wedges, to permit post winding assembly, and the four rectangular windings may be substantially planar. Finally, the signal ports may be twisted pair, coaxial signal ports or transitions to waveguide structures.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
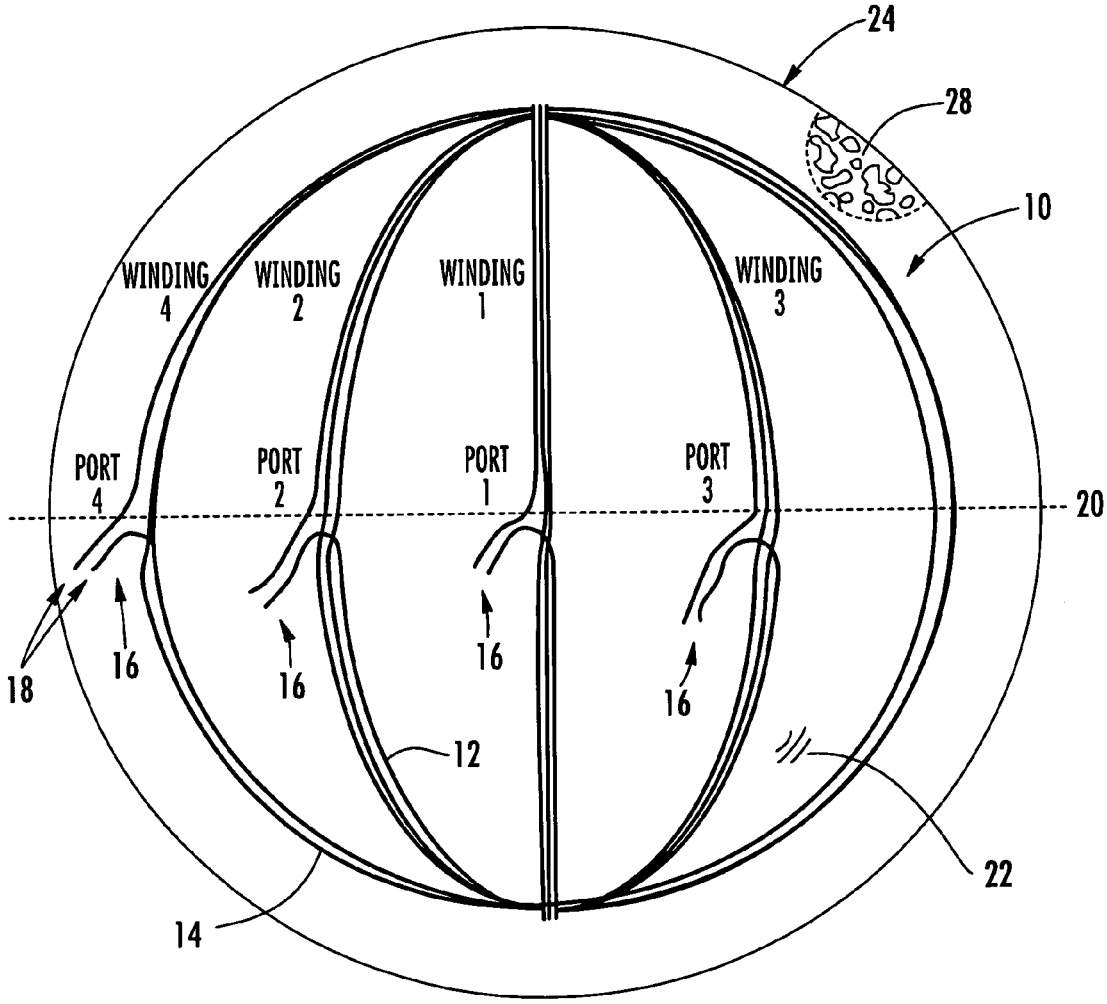
FIG. 1 is a side view schematic diagram of a hybrid junction according to a first embodiment of the invention.
Figure 2:
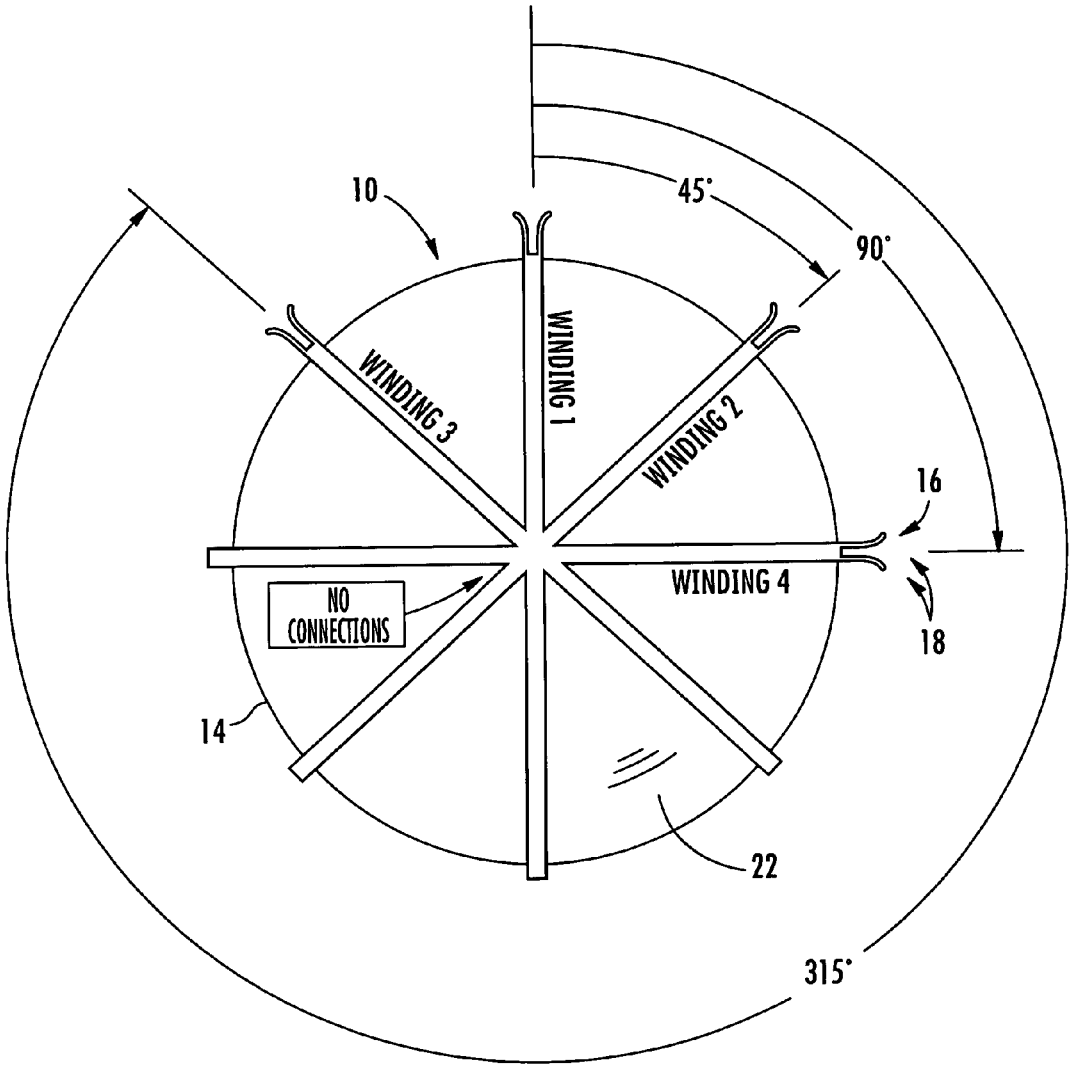
FIG. 2 is a top view of the hybrid junction of FIG. 1.

Referring initially to FIGS. 1 and 2, a hybrid junction 10, and associated method of making, according to a first embodiment will now be described. The hybrid junction 10 includes four circular electrically conductive windings 12 (WINDINGs 1-4) arranged so as to lie along an imaginary spherical surface 14. Each of the planes of the four circular electrically conductive windings 12 is spaced or rotated from adjacent windings by about forty-five degrees. The four circular electrically conductive windings 12 are electrically insulated from each other (e.g. by spacing or a dielectric at the crossing points) and each includes a respective signal port 16 (PORTs 1-4). Each signal port 16 may have two terminals 18, as is common.

Each of the circular electrically conductive windings 12 may include a plurality of turns. Also, a core 22 may be included within the four circular electrically conductive windings. The core may be one of a solid dielectric material, a gas dielectric material (e.g. air) or a nonconductive magnetic material. For example, a permeable magnetic core may be used at lower frequencies such as less than 2000 MHz. The diameter of the imaginary spherical surface 14 is preferably less than 1/20 wavelengths, The entire hybrid junction 10 may be enclosed in a spherical shell 24, which contains a fill material 28. For instance, the hybrid junction 10 may be immersed in granules of ferrite powder, with spherical shell 24 providing the containment. Fill material 28 may provide an enhanced magnetic circuit for the H fields of windings 12. Spherical shell 24 may be conductive, insulator, magnetic, or dielectric. When conductive however, shell 24 can shield the hybrid junction 10 from ambient fields, electric or magnetic, such those from say nearby power wiring. Note that in FIG. 2, an alternative view of the FIG. 1 embodiment, spherical shell 24 and fill material 28 are not shown. This is simply for the sake of drawing clarity, and spherical shell 24 and fill material 28 may be present in FIG. 2.

Each of the signal ports 16 may preferably lie along an equator 20 of the imaginary spherical surface 14, and each of the signal ports may be a balanced port, such as twisted pair, a coaxial signal port or with transitions, a waveguide signal port. Furthermore, the signal ports are preferably connected to define a 0 degree coupler, or a 180 degree coupler, by reversing connections to terminals 18, as may be appreciated by those skilled in the art.

A method aspect is directed to a method of making a hybrid junction 10 including forming four circular electrically conductive windings 12 arranged so as to lie along an imaginary spherical surface 14, and spacing each of the four circular electrically conductive windings from adjacent windings by about forty-five degrees. The method also includes electrically insulating the four circular electrically conductive windings 12 from each other (e.g. by providing spacing or a dielectric at the crossing points). The method includes providing a respective signal port 16 for each of the four circular electrically conductive windings 12.

The method may also include providing a core 22 within the four circular electrically conductive windings 12, wherein the core is preferably a nonconconductive magnetic material:

solid, liquid, or gas. If conductive, the core material may be of insulated laminations, as is common in power transformers. The core 22 material may also have equal dielectric permittivity and magnetic permeability ($\mu=\epsilon$), forming an isoimpedance material, with a 377 ohm characteristic impedance matching free space.

Figure 3:
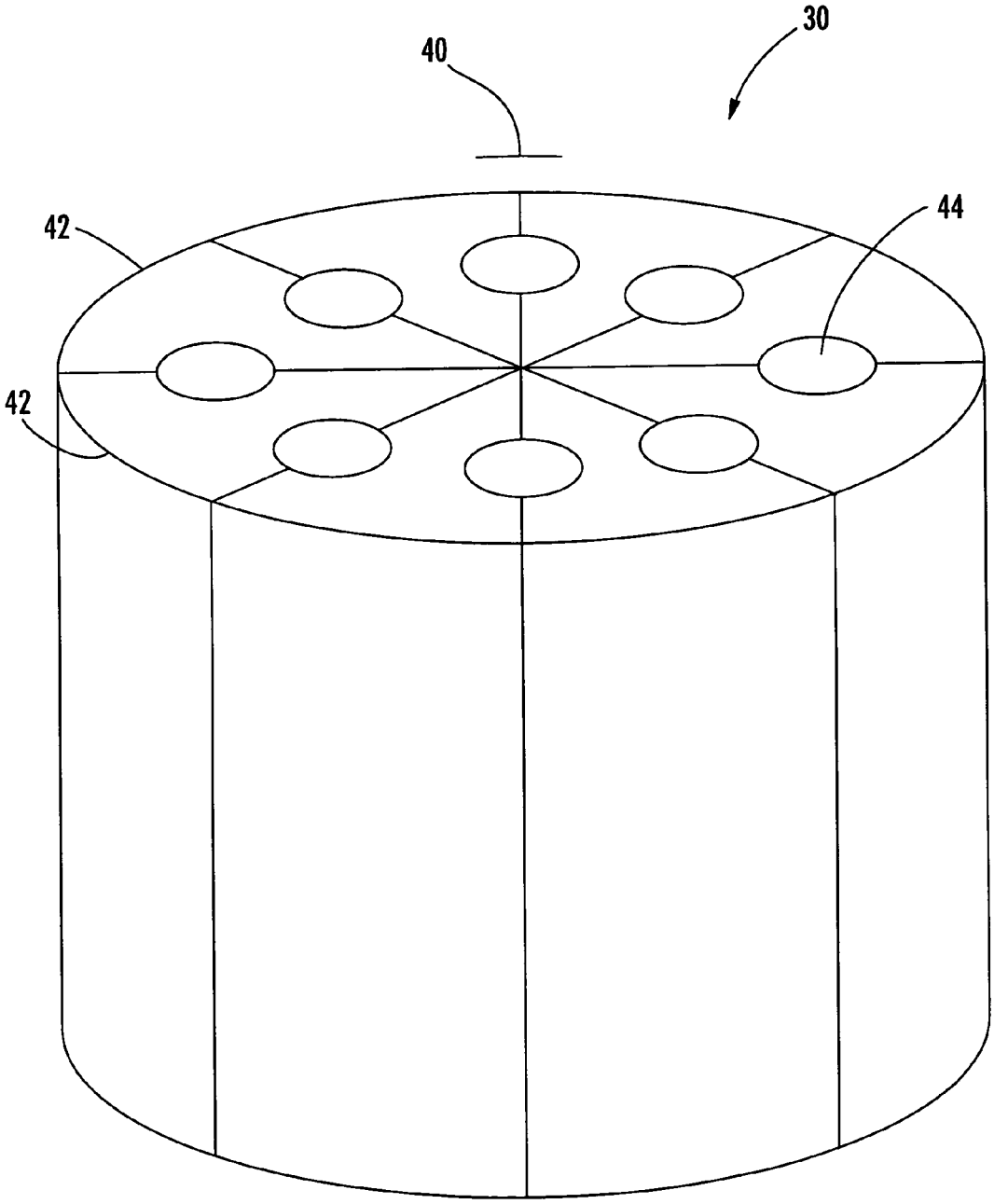
FIG. 3 is an isometric view of a cylindrical core according to another embodiment of the invention.
Figure 4:
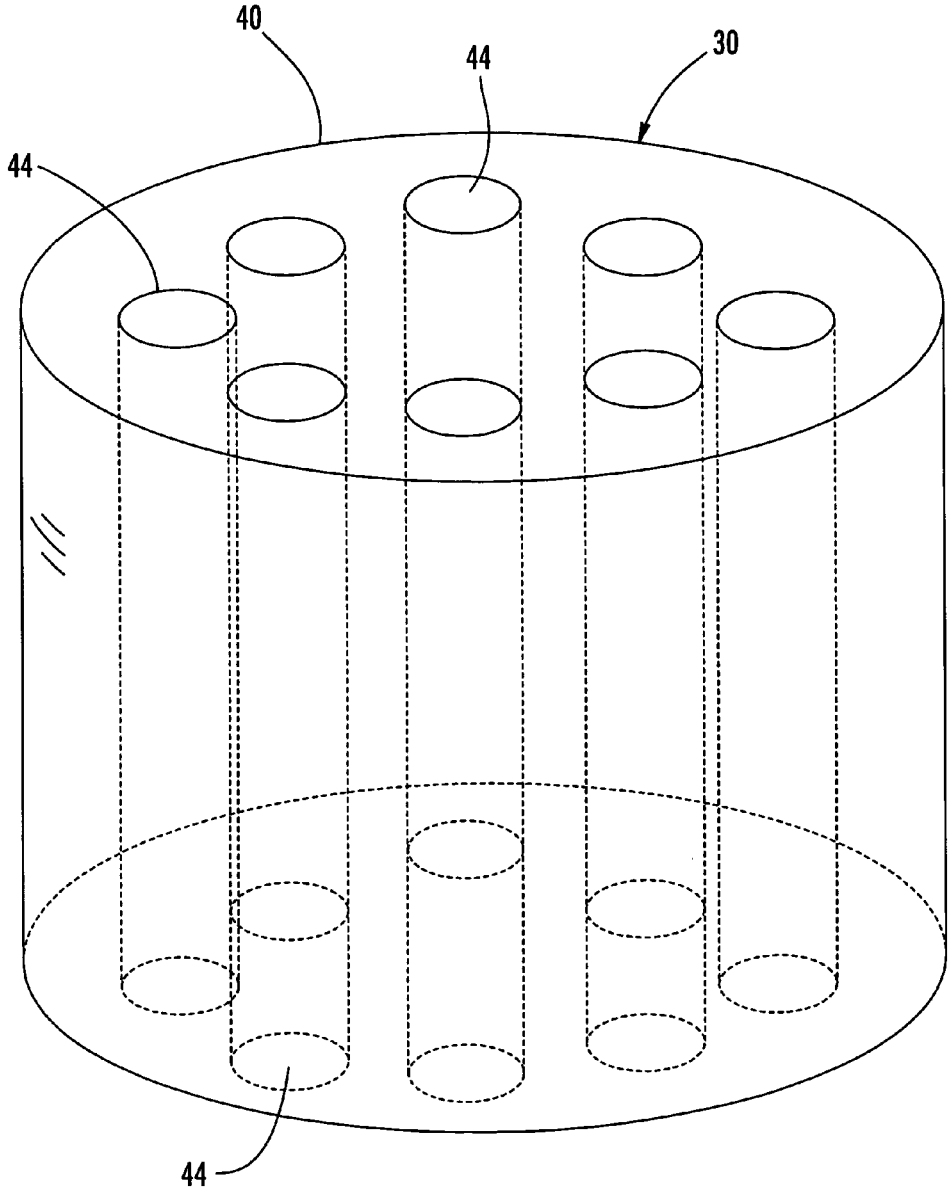
FIG. 4 is a transparent view of the cylindrical core, of the hybrid junction of FIG. 3.
Figure 5:
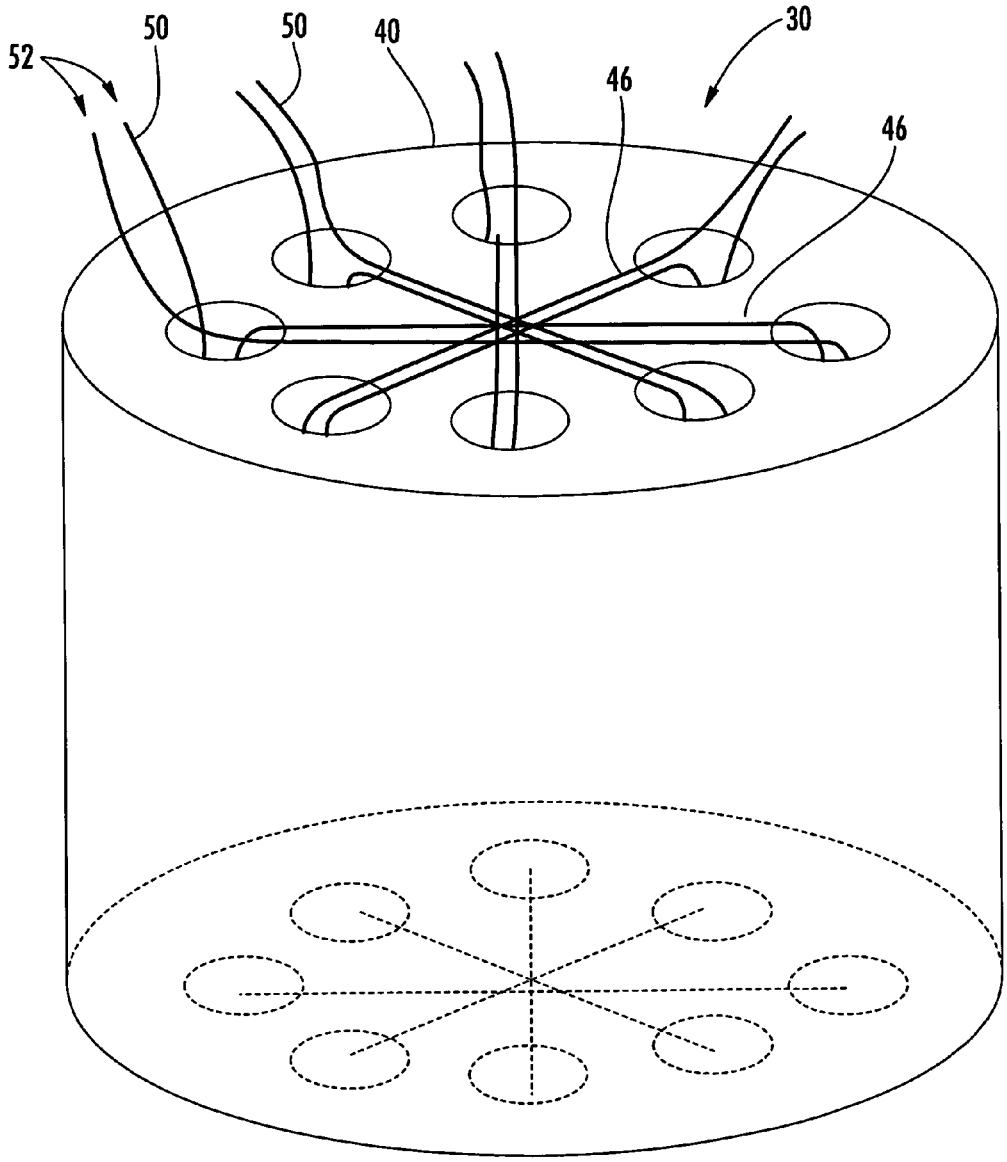
FIG. 5 is an isometric view of the cylindrical core including windings, of the hybrid junction of FIG. 3.
Figure 6A:
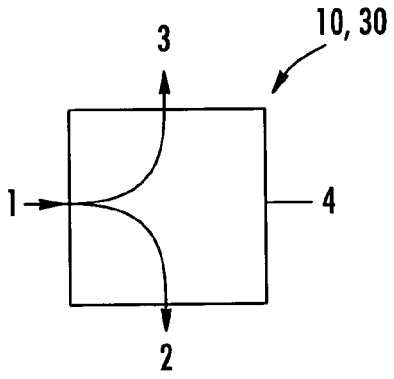
FIGS. 6A-6D are schematic diagrams illustrating the splitting of signals of the hybrid junction according to the invention.
Figure 6B:
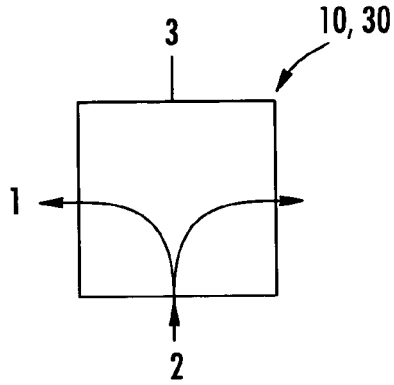
Figure 6C:
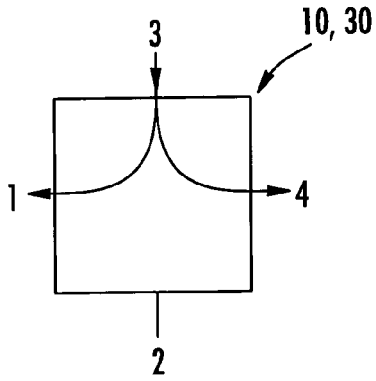
Figure 6D:
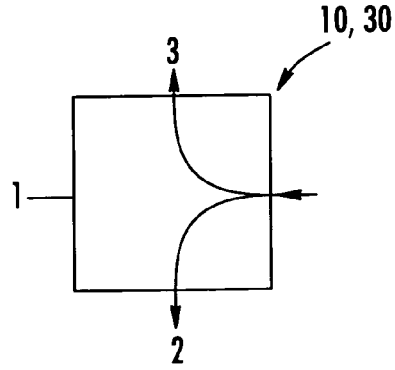

A hybrid junction 30 according to another embodiment, which may be preferential for manufacturing purposes, will be described with reference to FIGS. 3-5. The hybrid junction 30 includes a core 40, which may be any combination of magnetic or dielectric materials. Typically, at lower frequencies, core 40 is a nonconductive magnetic material such as ferrite or E iron, and core 40 is small relative to wavelength. Core 40 is configured with holes 44, which may be eight in number, to form vias. Holes 44 are arranged on a circular baseline, typically having a radius 0.25 that of the diameter of core 40, and they go all the way through the core 40, forming vias or pathways. Core 40 may also sectioned, e.g. into wedges, to facilitate its assembly in place, after windings 46 have been constructed.

Holes 44 are be used to receive windings 46. Each winding is substantially planar, with the wires jumping to opposite rather than adjacent holes. There are no connections where the wires cross, and the windings may be made of, for instance, enameled magnet wire. The two wire ends from each winding become terminals 52, forming a respective port 50, and may connected to an electrical network, as will be appreciated by those skilled in the art. Connections to terminals 52 may be reversed to provide a 0 or 180 degree phase hybrid as desired.

Optionally, the two wire ends, or "leads", from each winding may be twisted together, as they egress from core 40, to form a balanced transmission line of controlled characteristic impedance. This may be done on any embodiment of the present invention.

The hybrid junction of the present invention includes rotationally offset winding planes which are preferably at about 45 degrees. As would be appreciated by those skilled in the art, performance of the hybrid junction would degrade with angles that varied further from 45 degrees. No center taps are needed and a magnetic core is not needed. The geometries of the hybrid junction are optimally spherical, as in the FIG. 1 embodiment, because of the circular windings. The cylindrical core embodiment, of FIGS. 3-5, may however be preferred for manufacturing purposes. The FIG. 1 embodiment conveys the theoretically ideal geometry for the present invention, a cross plane hybrid transformer.

Referring to FIGS. 6A-6D, the operative results of the hybrid junction 10, 30 automatically splitting and/or sorting signals will be described. Port 1 couples equal magnitude and opposite phase to Ports 2 and 3, with no coupling to Port 4. Port 2 couples equal magnitude and opposite phase to Ports 1 and 4, with no coupling to Port 3. Port 3 couples equal magnitude and opposite phase to Ports 1 and 4, with no coupling to Port 2, i.e. $S_{13}=-S_{43}$ and $S_{23}=0$. Port 4 couples equal magnitude opposite phase to Ports 2 and 3, with no coupling to Port 1. The hybrid junction is reciprocal and all ports are completely matched. The function also my be written in algebraic form:

$$S_{n,m} = 1\Big/\sqrt{2}\begin{bmatrix} 0 & 0 & -1 & 1 \\ 0 & 0 & -1 & 1 \\ 1 & -1 & 0 & 0 \\ 1 & -1 & 0 & 0 \end{bmatrix}$$

*S* Parameter Matrix

Figure 8A:
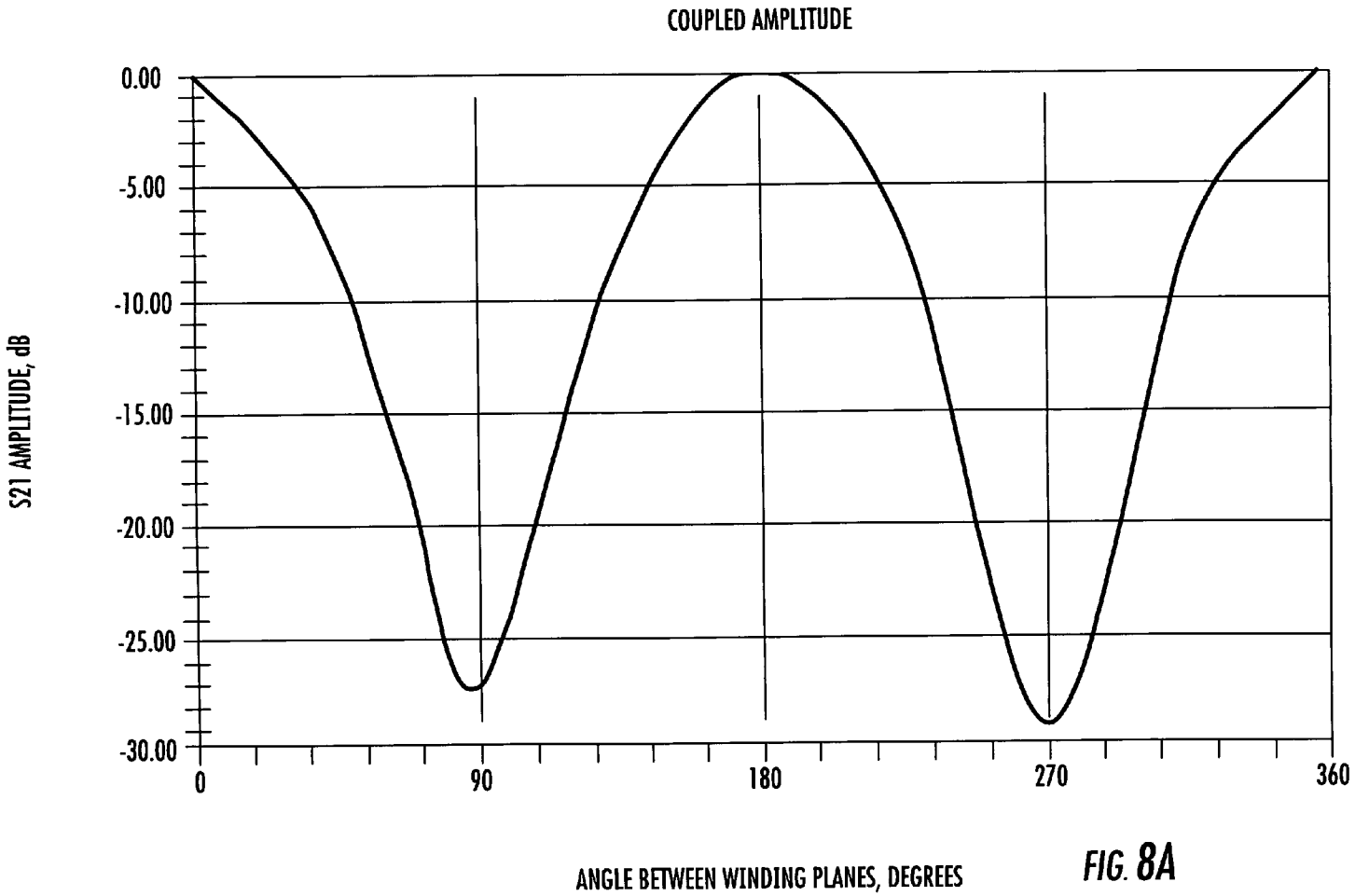
FIGS. 8A-8B are graphs of coupling between two windings, in amplitude and phase, measured as a function of angular rotation.
Figure 8B:
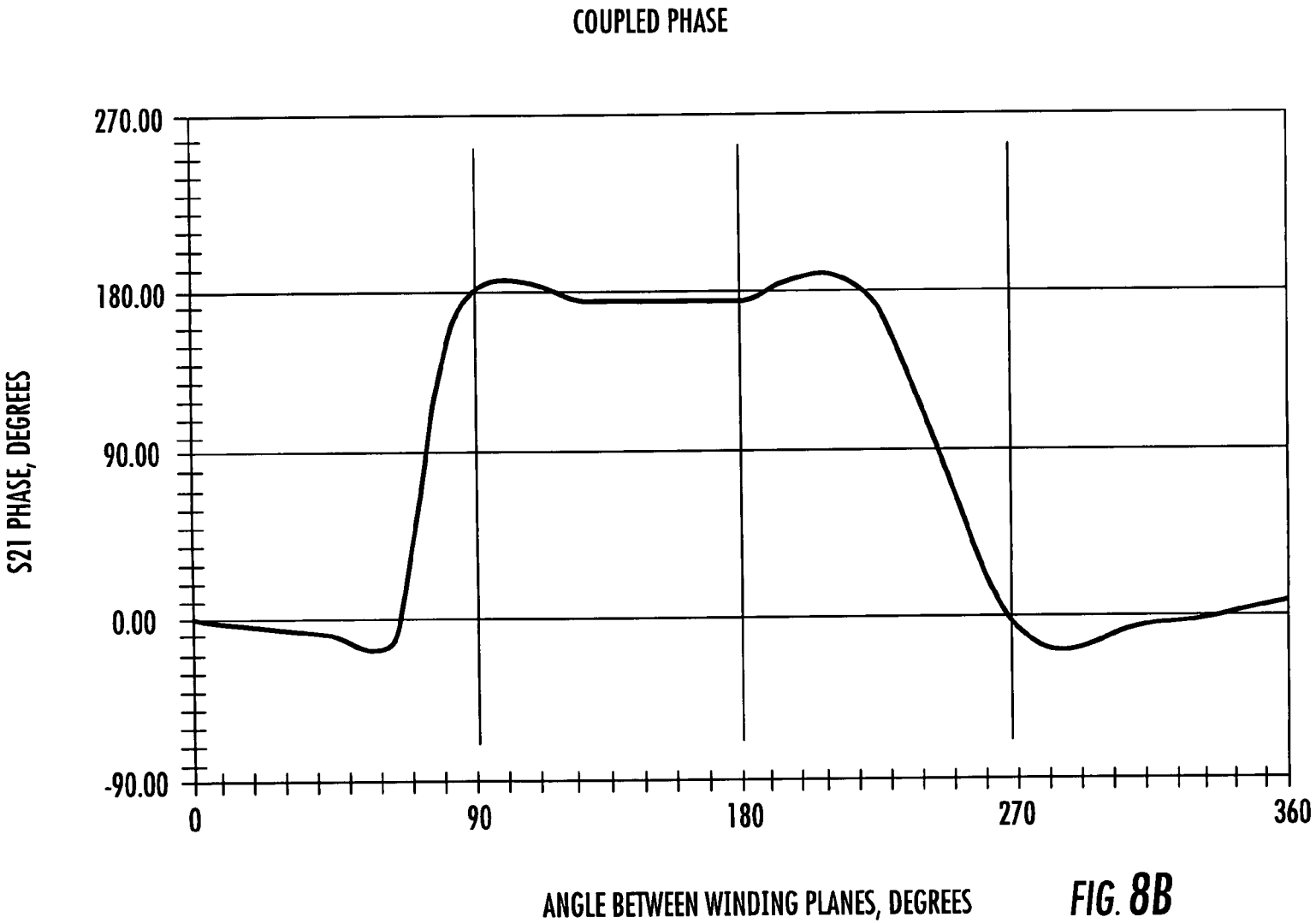

As background, the operation of a simplified two winding educational system will be described. FIGS. 8(A, B) are graphs of the measured coupling between two windings as a function of their angular displacement. Only two windings are present in the FIG. 8(A, B) educational system, they are operated together as a transformer, and one winding is rotated out of the plane of the other as in a variometer (variable transformer). The data is normalized to the case of the two windings being coplanar. Attention is called to the fact the phase advances by approximately 180 degrees as the rotated winding passes between 90 to 180 degrees physical rotation. This is important to the operation of this invention, as will be seen in the theory of operation.

A theory of operation for the complete invention will now be described. Referring to FIG. 2, winding 1 is driven by a RF (radio frequency) potential. Windings 1 and 4 are orthogonal to each other, such that magnetic fields from winding 1 do not curl through the aperture of winding 4. In the present invention, perpendicular windings are uncoupled from each other.

Continuing the theory of operation, windings 2 and 3 are however coupled to winding 1, as they are not orthogonal to 1. The magnetic fields from winding 1 curl equally through the aperture of windings of 2 and 3, causing equal power division to them, since there is symmetry about the plane of 4. Now windings 2 and 3 can of course couple to winding 4, as well as to 1, and isolation between 1 and 4 is desired. Notice however, that the plane of winding 3 is rotated 315 degrees clockwise from the plane winding 1, such that winding 3 has "passed through" the plane of winding 1, causing a 180 degree phase shift has to occur in its induced fields. Thus, although windings 2 and 3 do couple individually to winding 1, fields from 2 and 3 are 180 degrees out of phase with each other, and they cancel out in 4. Thus, 2 and 3 refer 180 out of phase in 4 and 1, in combination causing isolation between 4 and 1.

The present invention may form a loose or tight coupler, depending on the magnetic flux density produced by the windings. Either tight or loose couplers can be advantageous, depending on requirements. Loose coupling is advantageous say for instrumentation, by reducing disturbance to the connected network. For tighter coupling, windings (12, 46) can contain a large number of turns N, core (22, 40) can be of large diameter, or core (22, 40) can have high magnetic permeability. In general, the inductive reactance of windings (12, 46) should be 4 or more times greater than the circuit impedance into which they are connected, as is common in RF transformer design.

Windings 12, of hybrid junction 10 (spherical core), and windings 46 of hybrid junction 30 (cylindrical core) are operable in two modes relative to size and resonance: electrically small nonresonant or electrically large self resonant. Generally, the preferred mode is nonresonant windings, as is typical in transformers. However for requirements such as high power levels, self resonant windings may be beneficial. Such a hybrid is of larger physical size and heat dissipation. Depending on turns N, winding technique, and distributed capacitance, the length of the wire used in a self resonant winding may be about 0.2 to 0.45 wavelengths. The instantaneous bandwidth of resonant windings is narrow, approximately 0.5 to 2 percent, but they may be made tuneable.

Windings (12, 46) are in general short solenoids. However, informal scramble winding is sufficient for low frequency requirements. If multiple winding layers are needed, at higher frequencies, bank winding may be used to raise frequency response.

Figure 7:
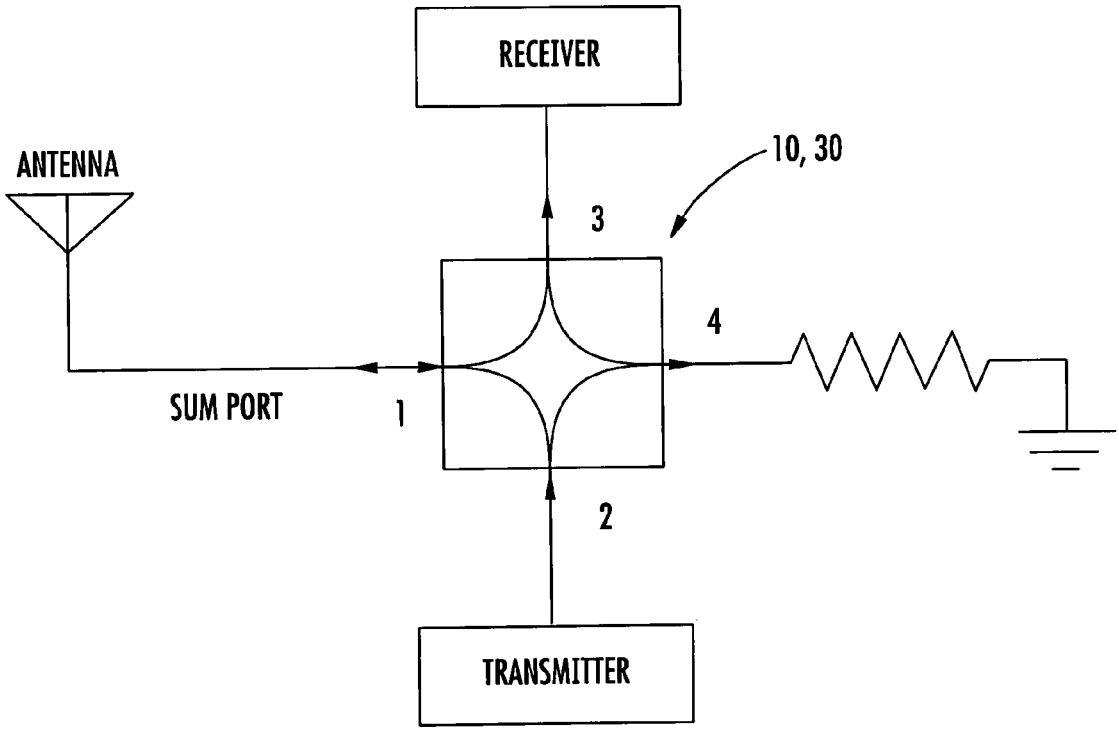
FIG. 7 is a schematic diagram illustrating the hybrid junction of the invention operating as a duplexer for a transmitter and receiver.

The port connections for the present invention can be telephone lines, with the windings wires forming a twisted pair, or coaxial cables to antennas, or with transitions waveguides to RADARS. The hybrid junction can be described as a transformer, coil, coupler, magic-T or phantom circuit. The hybrid junction may be used in telephones, RF mixers, Superheterodyne receivers, circular polarized antennas, transmit-receiver TR duplexers, bi-directional amplifiers/repeaters, undersea cables and ignitions, for example. As illustrated in FIG. 7, the hybrid junction 10, 30 may operate as a duplexer for a transmitter and receiver using the same antenna.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A hybrid junction comprising:

four electrically conductive windings, arranged so as to lie along an imaginary spherical surface;

the four electrically conductive windings each being rotated from adjacent windings by about forty-five degrees;

the four electrically conductive windings being electrically insulated from each other;

the four electrically conductive windings each comprising a respective signal port.

2. The hybrid junction according to claim 1 wherein each of the electrically conductive windings comprises a plurality of turns.

3. The hybrid junction according to claim 1 wherein the windings are planar and circular.

4. The hybrid junction according to claim 1 further comprising a core within the four circular electrically conductive windings.

5. The hybrid junction of claim 4 where the core is cylindrical, and the windings are planar and circular.

6. The hybrid junction of claim 4 where the core contains holes to receive the windings.

7. The hybrid junction according to claim 4 wherein the core comprises at least one of a solid dielectric material, a gas dielectric material and a magnetic material.

8. The hybrid junction according to claim 1 wherein a diameter of the imaginary spherical surface is less than or about 1/20 wavelengths.

9. The hybrid junction according to claim 1 wherein each of the signal ports lie along an equator of the imaginary spherical surface.

10. The hybrid junction according to claim 1 wherein each of the signal ports comprises at least one of a coaxial signal port and a waveguide signal port.

11. The hybrid junction according to claim 1 wherein the signal ports are connected to define one of a 180 degree coupler and a 0 degree coupler.

12. A method of making a hybrid junction comprising:

forming four circular electrically conductive windings arranged so as to lie along an imaginary spherical surface;

rotating each of the four circular electrically conductive windings from adjacent windings by about forty-five degrees;

electrically insulating the four circular electrically conductive windings from each other; and providing a respective signal port for each of the four circular electrically conductive windings.

13. The method according to claim 12 further comprising providing a core within the four circular electrically conductive windings, wherein the core comprises at least one of a solid dielectric material, a gas dielectric material and a magnetic material.

14. The method according to claim 12 wherein each of the signal ports is provided along an equator of the imaginary spherical surface and comprises at least one of a coaxial signal port and a waveguide signal port.

15. A hybrid junction comprising:

four rectangular electrically conductive windings arranged so as to lie in or on an imaginary cylindrical surface;

the four rectangular electrically conductive windings each being spaced from adjacent windings by about forty-five degrees;

the four rectangular electrically conductive windings being electrically insulated from each other;

the four rectangular electrically conductive windings each comprising a respective signal port.

16. The hybrid junction according to claim 15 further comprising a core within the four rectangular electrically conductive windings.

17. The hybrid junction according to claim 16 wherein the core comprises at least one of a solid dielectric material, a gas dielectric material and a magnetic material.

18. The hybrid junction according to claim 15 wherein a radius of the imaginary winding surface is 1/20 wavelengths or less.

19. The hybrid junction according to claim 15 wherein the terminals of the four rectangular electrically conductive windings form twisted pairs.

20. The hybrid junction according to claim 15 wherein each of the signal ports comprises at least one of a coaxial signal port and a waveguide signal port.

21. The hybrid junction according to claim 15 wherein the signal ports are connected to define one of a 0 degree coupler and a 180 degree coupler.

22. A method of making a hybrid junction comprising:

forming four rectangular electrically conductive windings to lie along an imaginary rectangular surface spacing each of the four rectangular electrically conductive windings from adjacent windings by about forty-five degrees;

electrically insulating the four rectangular electrically conductive windings from each other; and providing a respective signal port for each of the four rectangular electrically conductive windings.

23. The method according to claim 22 further comprising providing a core within the four rectangular electrically conductive windings, the core comprising at least one of a solid dielectric material, a gas dielectric material and a magnetic material.

24. The method according to claim 22 wherein providing the signal ports comprises providing at least one of coaxial signal ports and waveguide signal ports.

* * * * *